US005192180A

United States Patent [19]

Kolleth

[11] Patent Number: 5,192,180

[45] Date of Patent: Mar. 9, 1993

[54] LOAD-RELIEVING DEVICE FOR SERVOMOTORS ADJUSTING THE HEIGHT OF CANTILEVER ARMS

[75] Inventor: Horst Kolleth, Krefeld, Fed. Rep. of Germany

[73] Assignee: Krupp Industrietechnik Gesellschaft mit beschränkter Haftung, Duisburg, Fed. Rep. of Germany

[21] Appl. No.: 806,316

[22] Filed: Dec. 13, 1991

[30] Foreign Application Priority Data

Dec. 14, 1990 [DE] Fed. Rep. of Germany ..... 4039973

[51] Int. Cl.[5] ..... B66C 3/20

[52] U.S. Cl. ..... 414/719; 29/402.03; 29/402.08; 212/196; 254/123; 198/509

[58] Field of Search ..... 414/680, 719; 212/196, 212/195; 299/89, 55, 56; 37/189, 190; 29/402.03, 402.08; 254/123, 88; 198/509

[56] References Cited

U.S. PATENT DOCUMENTS 3,635,486 4/1972 McLean et al. ..... 414/719
3,931,956 1/1976 Hawkins ..... 254/8 B
4,004,696 1/1977 Briggs ..... 212/196

*Primary Examiner*—Michael S. Huppert
*Assistant Examiner*—Donald W. Underwood
*Attorney, Agent, or Firm*—Spencer, Frank & Schneider

[57] ABSTRACT

An apparatus including a frame, a cantilever arm movably mounted on the frame, and a servomotor operatively connected to the frame and the cantilever arm for setting a height position of the cantilever arm. The servomotor is exposed to tension loads derived from forces acting on the cantilever arm. The apparatus further includes a device for relieving the servomotor of the tension loads for an arbitrary period. The device includes a tension member attached parallel to the servomotor for the arbitrary period. The device further has an intermediate member having a first pivot joint operatively articulated to the cantilever arm for introducing the tension loads into the intermediate member, a second pivot joint for being coupled to an end of the tension member and a third pivot joint for being releasably coupled to the servomotor. The first, second and third pivot joints are spaced from one another and form the three corners of an imaginary triangle.

4 Claims, 1 Drawing Sheet

LOAD-RELIEVING DEVICE FOR SERVOMOTORS ADJUSTING THE HEIGHT OF CANTILEVER ARMS

CROSS REFERENCE TO RELATED APPLICATION

This application claims the priority of German Application No. P 40 39 973.7 filed Dec. 14, 1990, which is incorporated herein by reference.

BACKGROUND OF THE INVENTION

This invention relates to a device for relieving tension-loaded servomotors employed for the height adjustment of cantilever arms, particularly the cantilever arms of open-pit mining equipment. The apparatus includes at least one pulling member being connectable in parallel with the servomotor or servomotors.

Cantilever arms of machines such as open-pit mining equipment, cranes and similar conveying devices often include tension-loaded servomotors for height adjustment, particularly hydraulic cylinders. If—for example, in the case of a malfunction—the servomotor must be replaced, the problem is encountered that before the servomotor can be relieved of the tension load, the cantilever arm must be fixed in its position. This is customarily effected by a supporting framework which supports the cantilever arm or, as the case may be, the heavier counterweight cantilever arm against the ground. It is a disadvantage of such a method that it requires significant material input, it is time-consuming and it is not reliable.

Instead of a supporting framework, as outlined above, additional guying has been employed by attaching a tension cable parallel to the servomotor so as to absorb the tensile forces after the servomotor has been relieved of loads. In order to avoid damage to the hydraulic cylinder, the cable must be disposed at a sufficient distance from the latter. Fastening of the cable generally proves difficult because special and sufficiently stable attachment means, for example eye straps, are not available or cannot be applied. Moreover, the cable must also be provided with suitable attachment means and must have a defined length.

SUMMARY OF THE INVENTION

It is an object of the invention to provide an apparatus with which the servomotor can be relieved in the shortest time while simultaneously providing reliable substitute guying.

This object and others to become apparent as the specification progresses, are accomplished by the invention, according to which, briefly stated, the device for relieving the servomotor of the tension loads for an arbitrary period includes an intermediate member having a first pivot joint operatively articulated to the cantilever arm for introducing tension loads, derived from forces acting on the cantilever arm, into the intermediate member, a second pivot joint for being coupled to an end of a tension member attached parallel to the servomotor for the arbitrary period and a third pivot joint for being releasably coupled to the servomotor. The first, second and third pivot joints are spaced from one another and form the three corners of an imaginary triangle.

It is an advantage of the invention that the intermediate member constitutes a simple, inexpensive component which, when not in use, remains disposed on the equipment so that a removal operation is not needed. Only a single additional attachment point is required for the pulling member; such an attachment point may be disposed in the immediate vicinity of the location of articulation of the adjustment motor so that no additional supporting structures are required.

The tension member is preferably a pull rod which is more easily manipulated than a cable. When not in use, the pull rod can be brought into a "parked" position, for example, it may be folded over in a simple manner.

While the device according to the invention is suitable for all types of equipment that are provided with a height-adjustable cantilever arm, it is primarily intended for open-pit mining equipment, such as bucket wheel excavators, bucket wheel loaders, stackers or the like, and is particularly suitable for the type of equipment in which the cantilever arm and the counterbalance cantilever arm are connected with one another by way of a luffing guying arrangement.

DESCRIPTION OF THE PREFERRED EMBODIMENTS

Figure 1:
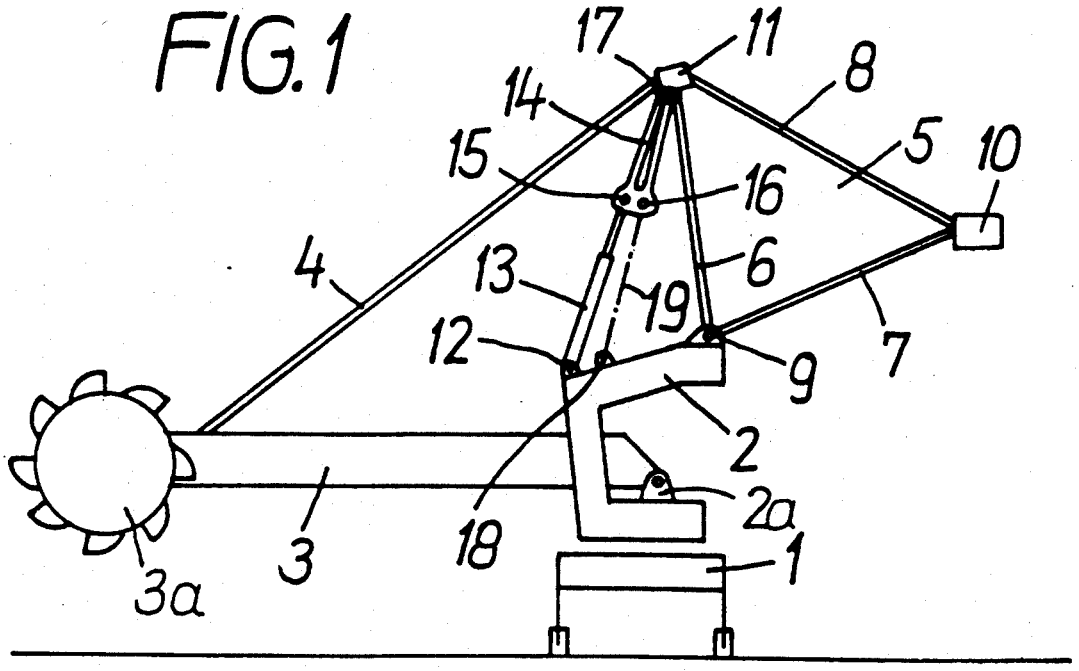
FIGS 1 and 2 are schematic elevational views of two preferred embodiments of the invention.
Figure 2:
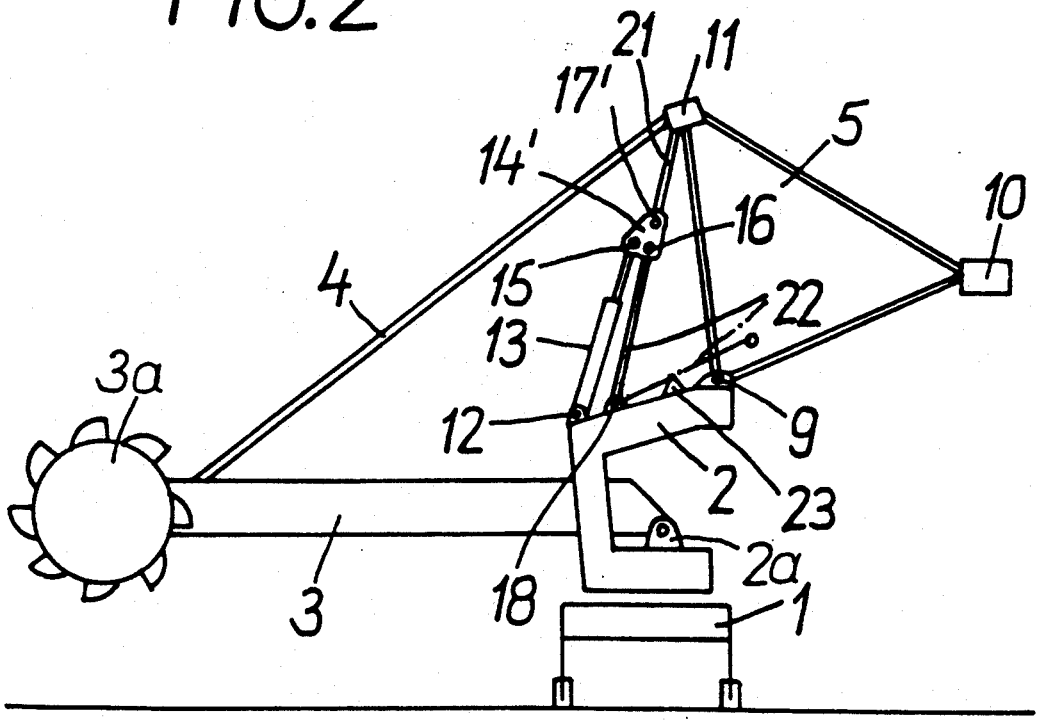

FIGS. 1 and 2 show a bucket wheel excavator, having a movable undercarriage 1 on which a C-shaped upper frame 2 is mounted for pivotal motion about a vertical axis. The upper frame 2 supports a cantilever arm 3 which carries a bucket wheel 3a at its outer end and which is articulated to the frame 2 at the joint 2a for the purpose of adjusting its height. Further, the cantilever arm 3 is connected by pull rods 4 (only one shown) with a triangular rocker 5 (luffing guying arrangement) composed of an approximately vertical bar 6 and an approximately horizontal bar 7 whose ends are connected with one another by pull rods 8 (only one shown). The rocker 5 is articulated to the upper region of the frame 2 for pivotal motion about a horizontal axis 9. A counterweight 10 is attached to a free corner of the triangular rocker 5.

Between a node 11, which is disposed at the upper end of bar 6 and connects pull rods 4 and 8 with one another, and an eyelet joint 12 disposed on the upper side of frame 2, a hydraulic cylinder 13 functioning as a servomotor and an intermediate member 14 are provided. The latter has pivot joints 15, 16 and 17 spaced from one another and forming the corners of an imaginary triangle. The piston rod of the hydraulic cylinder 13 is connected with pivot joint 15, while the pivot joint 17 is disposed at the node point 11 and introduces into the intermediate member 14 the loads derived from forces to which the cantilever arm 3 is exposed. Since the counterweight cantilever arm formed by rocker 5 and counterweight 10 is heavier than the bucket wheel cantilever arm 3 and the hydraulic cylinder 13 is exposed only to tension loads, the eyelet joint 12 is disposed opposite the rocker axis 9 on the side of bucket wheel cantilever arm 3. Between the eyelet joint 12 and the axis 9, immediately adjoining the eyelet joint 12, a joint 18 is fastened to the upper side of the frame 2.

In order to prepare for the removal of the hydraulic cylinder 13, the embodiment according to FIG. 1 uses a cable 19 which is provided with coupling means at both ends and is attached to joint 18 on the frame 2 and to pivot joint 16 of intermediate member 14. Then the piston rod of the hydraulic cylinder 13 is extended until the latter is completely relieved of loads which is the case when the cable 19 has taken over the full load. Depending on the arrangement of the pivot joints of the intermediate member 14, the joint 18 and the eyelet joint 12 on the frame 2, the intermediate member 14 pivots about the joint 17 in the direction of the bucket wheel cantilever arm 3 when the cable 19 takes over the load. The load-free hydraulic cylinder 13 can then be removed without difficulty, for example by means of a crane. It is noted that for this operation it is not necessary to support counterweight 10, for example by means of a framework (tower) resting on the ground, as it has been the practice in prior art apparatus. The installation of the hydraulic cylinder 13 is effected in the reverse sequence; as soon as the cylinder 13 has taken over the load, the cable 19 which has functioned as a substitute tension member, can be removed in a simple manner.

In the embodiment of FIG. 2, an intermediate member 14' is employed in which the space between the upper pivot joint 17', on the one hand, and the two lower pivot joints 15 and 16, on the other hand, is shorter than in the intermediate member 14 of the previous embodiment, so that the intermediate member 14' is not directly articulated to the node 11 but is connected therewith by a pull rod 21. The substitute tension member is a pull rod 22 which can be attached to the joint 18 of the frame 2 and to the joint 16 of the intermediate member 14'. Removal and installation of the hydraulic cylinder 13 is effected in the same manner as in the embodiment described in connection with FIG. 1. The pull rod 22 need not be removed entirely from the apparatus: it may be folded, for example, about the joint 18 into a detent member 23 disposed on the frame 2 as indicated by a dash-dot line in FIG. 2.

It will be understood that the above description of the present invention is susceptible to various modifications, changes and adaptations, and the same are intended to be comprehended within the meaning and range of equivalents of the appended claims.

What is claimed is:

1. In an apparatus including a frame, a cantilever arm movably mounted on the frame, counterweight means connected to said frame for counterbalancing said frame and said cantilever arm, and a servomotor connected to the frame and the cantilever arm for setting a height position of the cantilever arm; said servomotor being connected to the frame and the cantilever arm such that tension loads derived from forces acting on the cantilever arm are being introduced into the servomotor; a device for relieving the servomotor of the tension loads for an arbitrary period; said device including a tension member attached parallel to the servomotor for the arbitrary period; the improvement wherein said device comprises an intermediate member having a first pivot joint operatively articulated to said cantilever arm for introducing the tension loads into said intermediate member, a second pivot joint for being coupled to an end of said tension member and a third pivot joint for being releasably coupled to said servomotor; said first, second and third pivot joints being spaced from one another and forming the three corners of an imaginary triangle.

2. An apparatus as defined in claim 1, wherein said tension member is a pull rod and said end of said tension member is a first end of said pull rod; said pull rod having a second end; said servomotor being attached to said frame; further comprising attachment means for coupling said second end of said pull rod to said frame.

3. An apparatus as defined in claim 1, wherein said servomotor comprises a hydraulic cylinder.

4. An apparatus as defined in claim 1, wherein said apparatus is a bucket excavator including a bucket wheel mounted at an outer end of said cantilever arm; and a luffing guying connecting said counterweight means to said cantilever arm.

* * * * *